US005718139A

United States Patent [19]

Gardner

[11] Patent Number: 5,718,139

[45] Date of Patent: Feb. 17, 1998

[54] METHOD AND APPARATUS FOR CLOSING A TUBE STRUCTURE

[76] Inventor: Joe L. Gardner, 3030 Samoa Pl., Costa Mesa, Calif. 92626

[21] Appl. No.: 656,006

[22] Filed: May 24, 1996

[51] Int. Cl.[6] ..... B21D 41/04

[52] U.S. Cl. ..... 72/38; 72/126

[58] Field of Search ..... 72/67, 84, 115, 72/126, 38

[56] References Cited

U.S. PATENT DOCUMENTS

| | | | |
|---|---|---|---|
| 3,273,368 | 9/1966 | Sporck | 72/126 |
| 4,106,175 | 8/1978 | Meyer . | |
| 4,268,945 | 5/1981 | Arman et al. . | |
| 4,451,964 | 6/1984 | Ludwig . | |
| 4,480,730 | 11/1984 | Koller et al. . | |
| 4,619,130 | 10/1986 | Buzzi | 72/126 |
| 4,880,087 | 11/1989 | Janes . | |

FOREIGN PATENT DOCUMENTS

| | | | |
|---|---|---|---|
| 2652773 | 4/1991 | France | 72/67 |
| 1171148 | 8/1985 | U.S.S.R. | 72/67 |

*Primary Examiner*—Lowell A. Larson
*Attorney, Agent, or Firm*—Lowe, Price, LeBlanc & Becker

[57] ABSTRACT

An apparatus for deforming the end of a tube structure includes a closing tool moving in an orbital motion about the end of the tube while the tube is being advanced. The closing tool in combination with the force applied to advance the tube form the tube into the shape of the closing tool and over the internal components of the tube. The closing tool and one end of the tube can be combined in a chamber of the closing tool so that the tube end can be closed while the internal volume of the tube is pressurized. The closing tool is particularly adapted to deform the end of a tube structure of a shock absorber type device.

12 Claims, 5 Drawing Sheets

METHOD AND APPARATUS FOR CLOSING A TUBE STRUCTURE

FIELD OF THE INVENTION

The present invention is directed to the method and apparatus for closing a tube structure end, in particular, to a method and apparatus which utilize an eccentric drive body which travels in an orbital motion for tube closing.

BACKGROUND ART

In the field of shock absorbers, pneumatic counterbalance and the like, different methods and apparatus have been proposed for sealing or closing the end of the tubular component of these types of devices.

In U.S. Pat. No. 4,480,730 to Koller et al., a radial force is used in conjunction with a closure cap and the end of a shock absorber for sealing purposes.

U.S. Pat. No. 4,880,087 to Janes discloses another type of apparatus for sealing the end of a shock absorber. In this patent, a swaging operation is used in two steps to form a reduced diameter portion of the tube of the shock absorber device. The reduced diameter of the tube interfaces with a metal-insert seal to effectively seal the end of the tube.

U.S. Pat. No. 4,451,964 to Ludwig discloses another apparatus for sealing a pneumatic spring counterbalance. In this patent, a crimp die is used to seal the tube end of the counterbalance unit. An axial force is used for tube and crimping.

One of the drawbacks associated with these types of prior art devices is the need for high forces to deform the tube end of the device being manufactured. Another problem that exists for prior art methods and apparatus is the difficulty in both pressurizing the internal volume of a shock absorber type device and then effectively sealing the device end while maintaining the desired pressurization. Prior art methods and devices attempting to achieve these results are often expensive, unwieldy and complicated.

As such, a need has developed to provide an improved apparatus and method for deforming the end of a tube, particularly for shock absorber type applications wherein the tube internal volume is pressurized. Responsive to this need, the present invention provides both a method and apparatus which can deform the end of a tube using relatively low deforming forces and, if desired, can be used during pressurization of the tube internal volume.

SUMMARY OF THE INVENTION

Accordingly, it is a first object of the present invention to provide a method for closing the end of a tube.

Another object of the present invention is to provide an apparatus for closing the end of a tube.

A still further object of the present invention is to provide a method and apparatus to close the end of a tube of a shock absorber or similar device so as to seal the internal components thereof.

A further object of the present invention is to provide a method and apparatus for closing the end of a tube while the tube internal volume is pressurized.

Other objects and advantages of the present invention will become apparent as a description thereof proceeds.

In satisfaction of the foregoing objects and advantages, the present invention provides an apparatus for working the end of a tube, the apparatus comprising a frame, a drive assembly mounted to the frame, the drive assembly including a drive shaft having a first axis and an orbiting tool assembly.

The orbiting tool assembly includes an eccentric drive body coupled to the drive shaft and a cylindrical closing tool holder mounted to the eccentric drive body. The cylindrical closing tool holder is aligned with a second axis.

Rotation of the drive shaft by the drive assembly above the first axis imparts an orbital motion to the cylindrical closing tool holder. The tool holder includes a closing tool which has a work surface shaped to work an edge of the tube upon rotation of the closing tool and application of an axial force to the tube.

An actuator assembly is provided for applying the axial force to the tube, the force directed towards the orbiting tool assembly.

The apparatus can be adapted for working the end of a tube while the tube internal volume is pressurized. In this embodiment, a housing is provided which encloses the orbital tool assembly in conjunction with the frame to form a chamber. The housing also includes an opening to receive the tube. The chamber is sealed to permit pressurization thereof and pressurization of the internal volume of the tube.

Preferably, the orbital tool assembly uses a pair of inner and outer bearing rings to transmit the rotation of the drive assembly to the closing tool. The eccentric drive body is positioned between the inner and outer bearing rings.

The closing tool is preferably annular in shape with the working surface formed in a recess in the lower face thereof. The working surface preferably includes a radiused surface and an acutely angled surface with respect to the closing tool bottom surface. With this configuration, the closing tool working surface contacts only a portion of the tube edge so that a large pressure is applied to the tube and for a small force applied to the tube itself.

The present invention also discloses a method of deforming the end of a tube comprising the steps of applying an axial force to the tube and applying a lateral force to a portion of an edge of the tube. The lateral force is continually applied to subsequent portions of the tube edge by orbiting a closing tool about an axis of said tube, the closing tool contacting the edge portions in succession for the deformation.

Preferably, the tube is part of a shock absorber or similar device component and the tube end is curved inwardly to enclose internal components of these types of devices.

In another mode of the invention, the internal volume of the tube is pressurized during application of the axial force and the lateral force. The axial force is terminated by one of a displacement of the tube at a predetermined distance and/or reaching a predetermined axial force level.

BRIEF DESCRIPTION OF THE DRAWINGS

Reference is now made to the drawings accompanying the invention wherein.

DESCRIPTION OF THE PREFERRED EMBODIMENTS

The inventive method and apparatus for closing the end of a tube structure uses an orbital or hula-hoop like motion of a tool. The orbital motion permits the apparatus to be compact in design, thus allowing the entire apparatus to operate as a pressure vessel with a small enough volume to make it practical to gas pressurize an internal volume of the tube, e.g., a shock absorber or a similar device, at the same time that the tube end is being closed and sealed.

The inventive apparatus allows a tube such as that used in a shock absorber or strut to be either sealed or gas pressurized and sealed in one machine. The closing process comprises applying a localized high pressure to the tube so that the end thereof folds over the tube internal components for sealing purposes.

Although a shock absorber type structure such as a twin tube, mono tube, strut or a spring can be utilized with the inventive method or apparatus, any tube structure requiring deformation of one or both ends can be used with the inventive apparatus and method.

The inventive apparatus can be used to seal one or both ends of a shock absorber type structure. When sealing both ends, the inventive apparatus can be a substitute for welding the bottom of the shock absorber tube structure.

Figure 1:
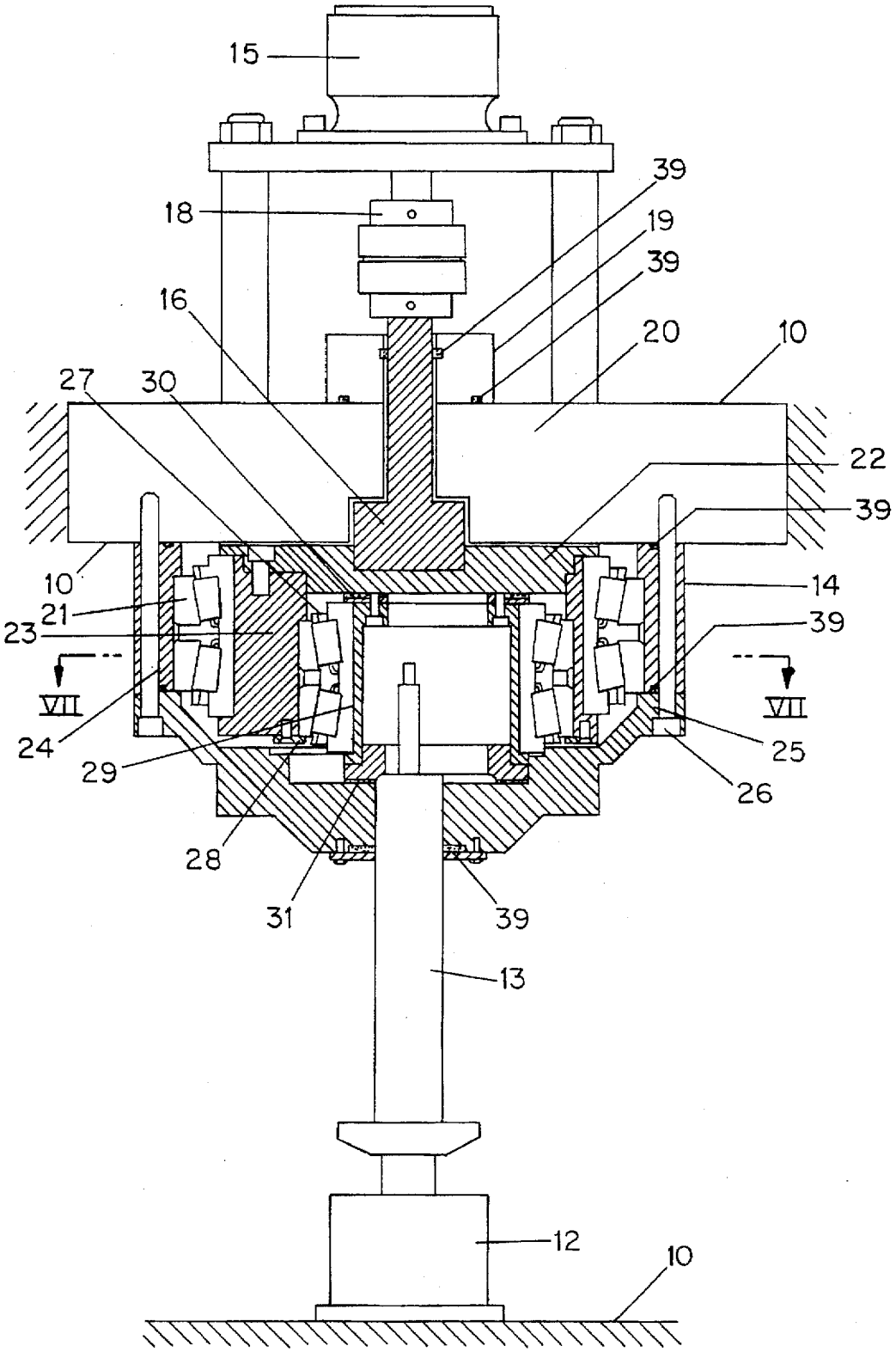
FIG. 1 is a schematic sectional view of one embodiment of the inventive apparatus.
Figure 4:
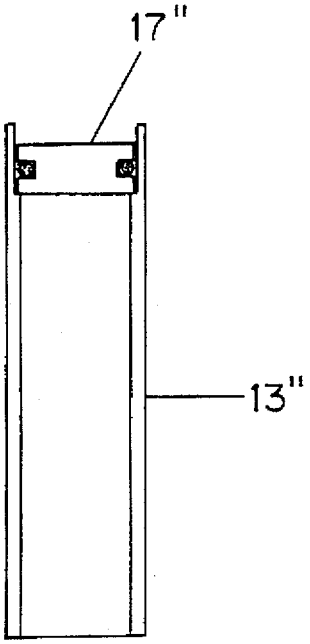
Figure 5:
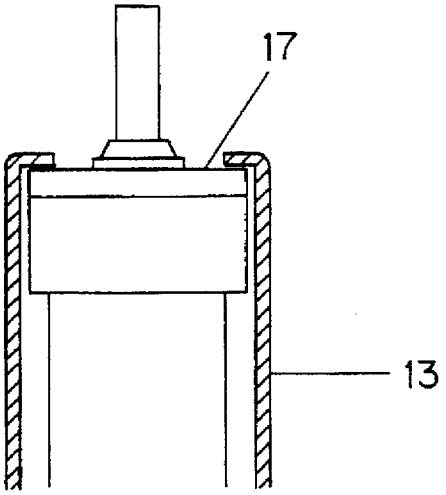
FIG. 5 is a schematic representation of an exemplary deformation of the tube depicted in FIG. 2.

A closing machine indicated schematically at FIG. 1 includes a frame 10 which is an ordinary load frame commonly used for production machinery, and is represented only by supports in FIG. 1. The load frame 10 includes an axial actuator 12 of conventional design that is used for applying compression force along a longitudinal axis of the tube indicated at 13 that is inserted into a closing head indicated at 14. The load frame 10 includes a rotary motor 15 of conventional design that is used for applying rotational motion to the drive shaft 16 that enters the closing head 14. The closing head 14 made according to the present invention is made so that the end of tube 13 inserted in closing head 14 can be closed over the internal components 17, 17' and 17" of FIG. 2, FIG. 3, FIG. 4, respectively, of the tube 13, 13' and 13", respectively. FIG. 5 illustrates an exemplary deformation of the tube end.

With reference to FIG. 1 again, a rotary motor 15 capable of running at a constant angular velocity drives a motor coupling 18. The motor coupling 18 connects to a drive shaft 16. The drive shaft passes through a pressure seal 19, load frame member 20, and connects to the outer bearing 21 drive cover 22. The outer bearing drive cover 22 connects to the eccentric drive body 23 that rotates at a constant angular velocity along with the inner race of the outer bearing 21. The outer race of the outer bearing 21 is clamped to the outer wall 24 by the lower cover 25 which is secured to the load frame 10 by fasteners 26. The inner bearing 27 outer race is clamped to the eccentric drive body 23 by a clamp ring 28 and rotates with the eccentric drive body 23.

Figure 6:
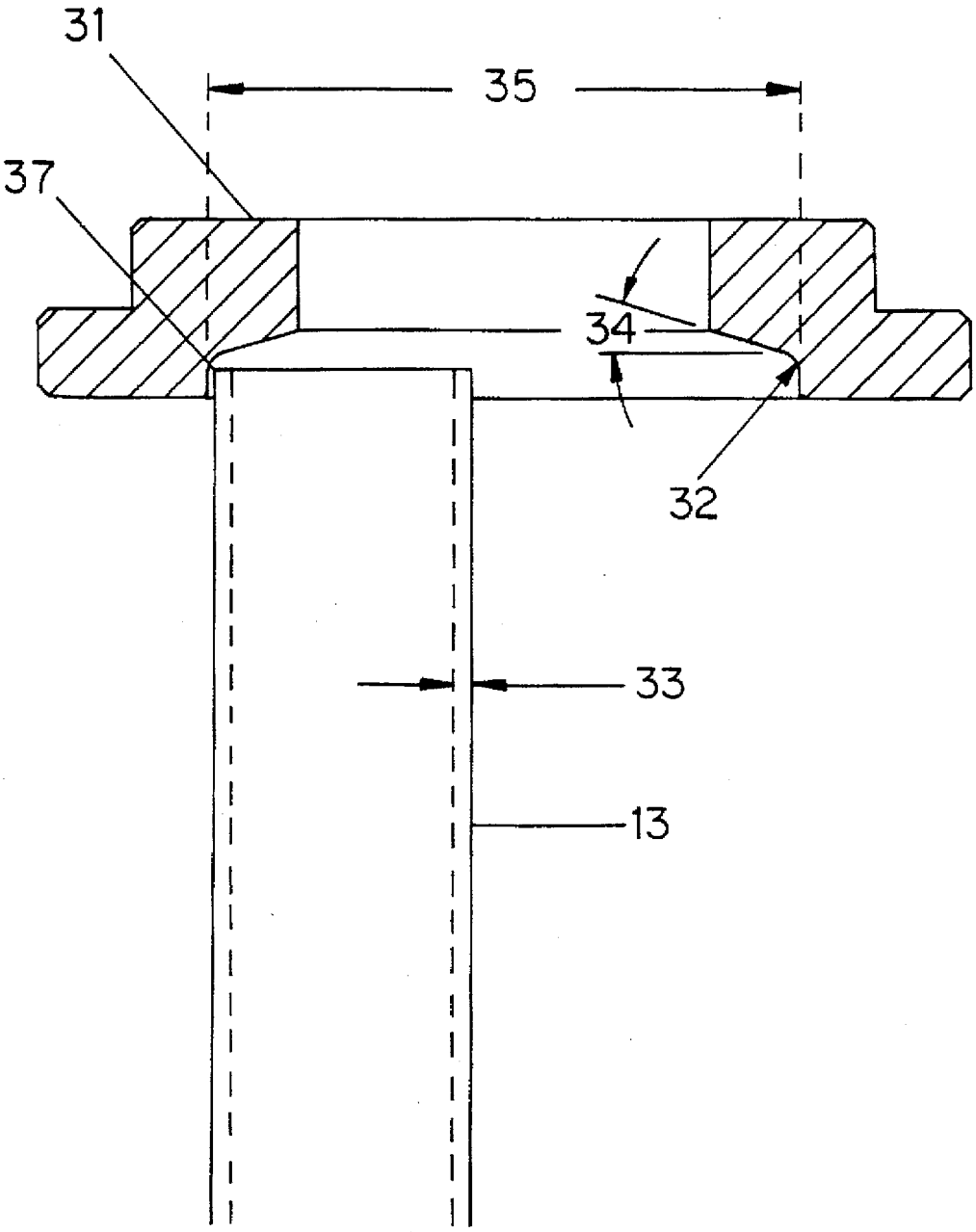
FIG. 6 shows a sectional view of the closing tool of the inventive apparatus and a tube end to be deformed.
Figure 7:
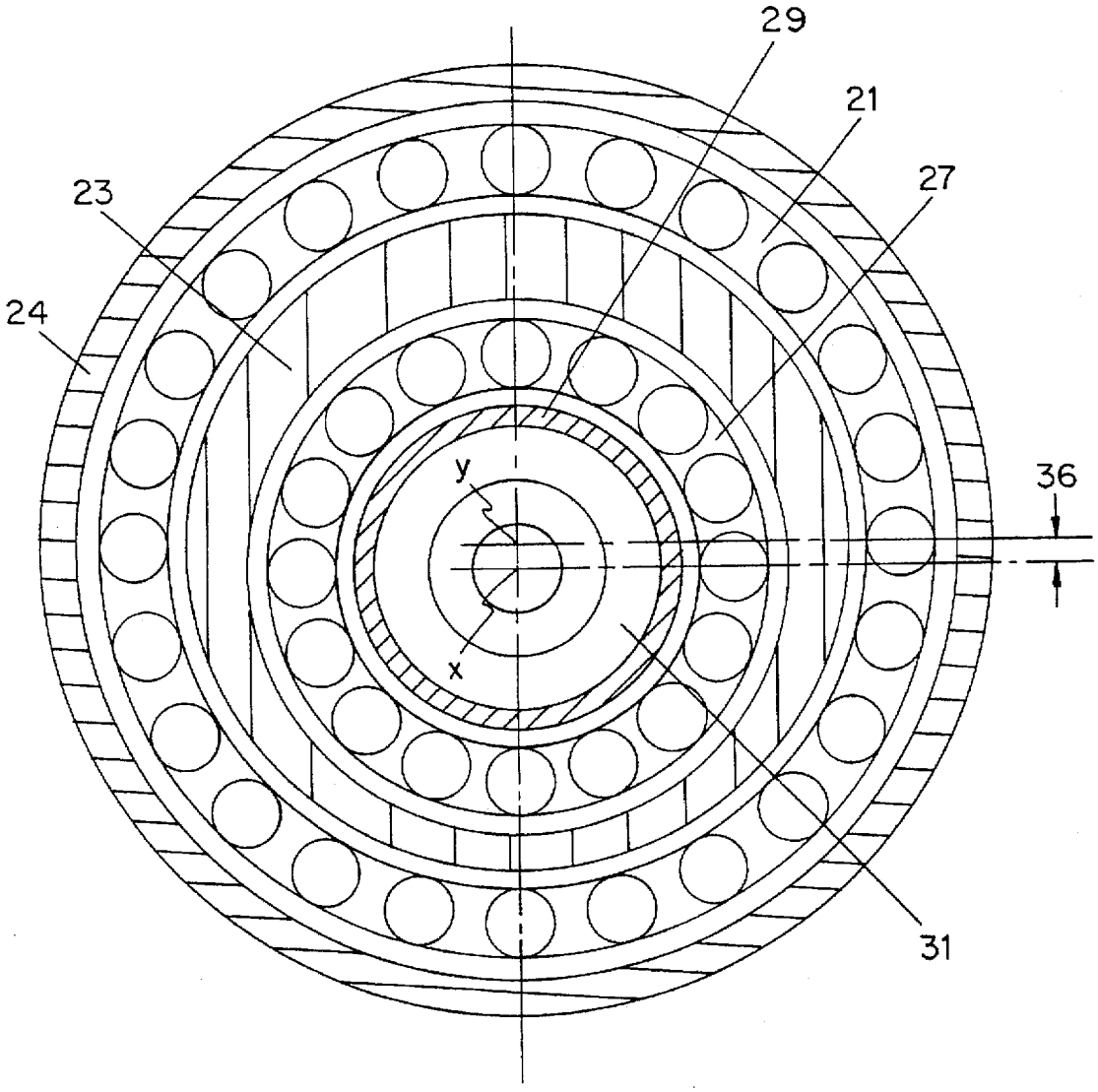
FIG. 7 is a schematic cross-sectional view on the line VII—VII of FIG. 1.

The inner bearing 27 inner race is clamped to the tool holder 29 by the clamp ring 30. The closing tool 31 is inserted into the tool holder with a close tolerance fit. The inner race of the inner bearing 27, the tool holder 29 and closing tool 31 move in an orbital motion around the edge of the tube 13 being closed. When the tube 13 is being closed, the actuator 12 advances the tube 13 into the closing tool 31 at a constant rate. Referring now to FIG. 6, the closing tool 31 has a radius 32 that is at a minimum 1.5 times the tube 13 wall thickness 33. The angle 34 is set to define the shape of the outside of the closed tube 13 and is typically between 6° to 15°. The diameter 35 is the tube 13 diameter plus two times the offset 36 in FIG. 7. The offset 36 is the distance between the center "X" of a circle defined by the inner bearing ring 27 and the center "Y" of a circle defined by the outer bearing ring 21.

Figure 8:
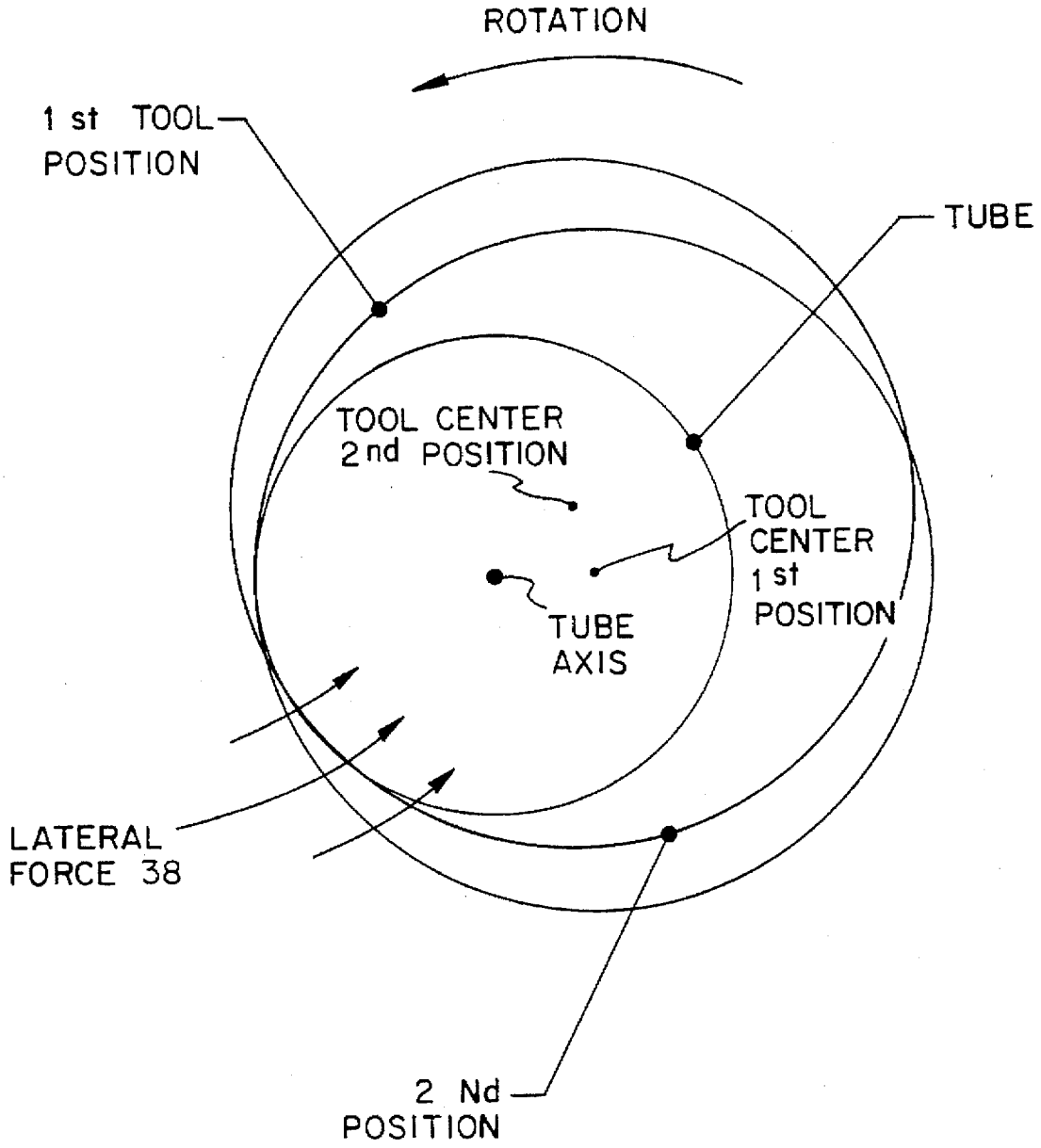
FIG. 8 is a schematic representation of the contact between the tube and closing tool as it orbits the tube axis.

As the tube 13 advances into the closing tool 31, the first point of contact will be the edge 37 of the tube 13 with the closing tool 31 radius 32. The motion of the tool as shown in FIG. 8 causes lateral force 38 to be input to the tube 13 edge 37. This lateral force 38 increases gradually as the tube 13 advances until the tube 13 wall yields. As the tube 13 advances the tube 13, edge 37 contacts the sloped portion of the closing tool 31 defined by angle 34. The motion of the tool as shown in FIG. 8 causes a lateral force 38 to be input to the tube 13 edge 37. This lateral force 38 continues to cause yielding of the tube 13 wall.

Referring now to FIG. 1, the lateral force being generated by the closing tool 31 acting on the tube 13 is transmitted to the load frame 10 via the contact point between the tube 13 and lower cover 25 via the outer wall 24.

The axial force created by the actuator 13 and the lateral force created by the contact between the tube 13 edge 37, and the closing tool is transmitted to the load frame 10 via the tool holder 29, inner bearing 27, eccentric drive body 23, outer bearing 21, and outer wall 24.

The tube 13 will stop advancing into the closing tool 31 when first a predetermined displacement of actuator 12 has occurred and second a force limit has been reached by actuator 12. Of course the order can be reversed so that the advancing is stopped by reaching the force limit just. Since the means and methods for measuring a given displacement of the actuator or sensing a force reached by the actuator and limiting additional applied forces are well known, a further description is not deemed necessary for understanding of the invention.

Figure 2:
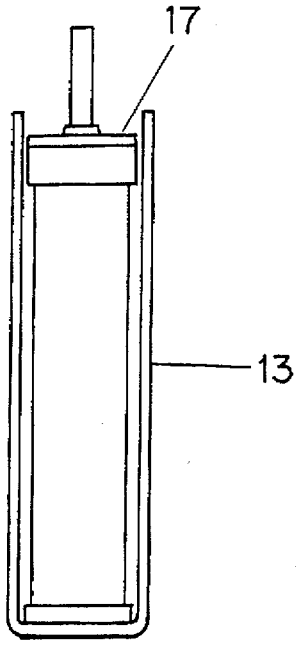
FIGS. 2–4 schematically depict different types of tubes and tube internal components for use with the inventive method and apparatus.
Figure 3:
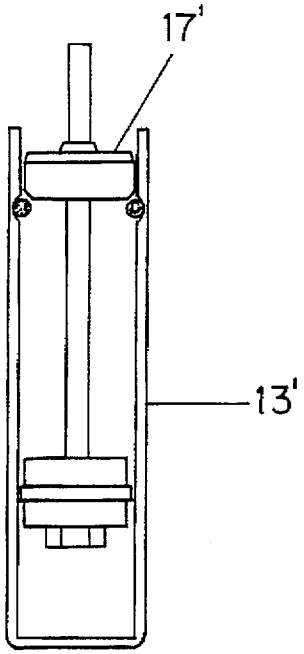

In the case where a tube 13 or 13' e.g., FIG. 2 or FIG. 3, is to be pressurized before closing, the closing head 14 is provided with seals 39 that make the closing head 14 a pressure vessel. When the tube 13 is in near contact with the closing tool 31, a pressure is applied to the interior of the pressure vessel via a source line (not shown) and at the same time to the interior of the tube 13. When the desired pressure is achieved, the closing process is started.

It should be understood that the control of the actuator displacement, actuator force limit or pressure within the interior of the pressure vessel can be controlled using known control means technology. That is, the pressure vessel could include a sensor therein designed to monitor the pressure and send a signal once a desired gas pressure is achieved to begin advancement of the tube towards the closing tool. Similarly, the displacement of the actuator can be monitored so that as the tube is being advanced toward a closing tool, the rotary motor 15 begins to drive the eccentric drive body and closing tool. As will be understood by one of ordinary skill in the art, the displacement travel by the advancing actuator and the force applied by the advancing actuator determine when the tube is completely formed. The rate of actuator advance and philosophy of the orbital motion of the closing tool can be controlled to achieve the tube and deformation.

As such, an invention has been disclosed in terms of preferred embodiments thereof which fulfill each and every one of the objects of the present invention as set forth above and provides an improved method and apparatus for closing a tube structure.

Of course, various changes, modification and alterations from the teachings of the present invention may be contemplated by those skilled in the art without departing from the intent and spirit of scope thereof. Accordingly, it is intended that the present invention only be limited by the terms of the appended claims.

I claim:

1. An apparatus for working an end of a tube comprising:

a frame;

a drive assembly mounted to said frame, said drive assembly including a drive shaft having a first axis;

an orbiting tool assembly further comprising:

i) an eccentric drive body coupled to said drive shaft for rotation thereof, ii) a hollow, empty cylindrical closing tool assembly holder mounted to said eccentric drive body and aligned with a second axis;

a closing tool shaped to work an edge of said tube, said closing tool being included in said cylindrical tool holder in a manner wherein rotation of said drive assembly about said first axis imparts an orbital motion to said cylindrical closing tool holder and the closing tool to work an edge of said tube upon rotation of said eccentric drive body and application of said axial force;

an actuator assembly for applying an axial force to said tube which biases said tube towards said orbiting tool assembly; and a housing, said housing being rigidly connected with said frame so that said housing and said and frame form a chamber which encloses said orbital tool assembly, said housing including an opening in which seal means is disposed to sealingly receive said tube to permit pressurization of the chamber.

2. The apparatus of claim 1, wherein said closing tool is annular in shape and includes a working surface which is recessed from a bottom surface of said closing tool, said working surface including a radiused surface.

3. The apparatus of claim 2, wherein the radius of said radiused surface is at least 1.5 times a thickness of a wall of said tube.

4. The apparatus of claim 2, wherein said working surface includes an acutely angled surface with respect to the bottom surface of said closing tool.

5. The apparatus of claim 4, wherein said acute angle ranges between about 6° and 15°.

6. An apparatus for working an end of a tube comprising:

a frame;

a drive assembly mounted to said frame, said drive assembly including a drive shaft having a first axis;

an orbiting tool assembly further comprising:

i) an eccentric drive body coupled to said drive shaft for rotation thereof, ii) a hollow, empty cylindrical closing tool assembly holder mounted to said eccentric drive body and aligned with a second axis;

a closing tool shaped to work an edge of said tube, said closing tool being included in said cylindrical tool holder in a manner wherein rotation of said drive assembly about said first axis imparts an orbital motion to said cylindrical closing tool holder and the closing tool to work an edge of said tube upon rotation of said eccentric drive body and application of said axial force;

an actuator assembly for applying an axial force to said tube which biases said tube towards said orbiting tool assembly; an outer bearing ring positioned between an inside of said housing and outer circumferential surface of said eccentric drive body; and an inner bearing ring positioned between an inner circumferential surface of said eccentric drive body and an outer circumferential surface of said cylindrical closing tool holder.

7. A method of deforming an end of a tube comprising the steps of:

a) applying an axial force to the tube;

b) applying a lateral force to a portion of an edge of said tube and continuing application of said lateral force to subsequent portions of said edge of said tube by orbiting a closing tool about an axis of said tube, said closing tool contacting said edge portions in succession for said deforming;

c) enclosing an end of the tube within a housing means and pressuring an internal cavity of said tube during the application of the axial force and the lateral force.

8. The method of claim 7, wherein said edge of said tube is curved inwardly by said closing tool to enclose internal components located within said tube.

9. The method of claim 7, wherein a shock absorber tube is provided for said deforming.

10. The method of claim 7, wherein the axial force is applied to an end of the tube opposite an end containing the edge.

11. The method of claim 7, wherein application of said axial force is terminated by one of displacement of said tube a predetermined distance and reaching a predetermined axial force level.

12. The method of claim 7, further comprising the step of disposing the end of the tube through an opening which is formed in said housing means and which is provided with sealing means to permit the pressurization of the internal cavity.

* * * * *